United States Patent [19]

Murphy

[11] Patent Number: 4,676,888

[45] Date of Patent: Jun. 30, 1987

[54] HYDROCARBON CONVERSION PROCESS WITH PRODUCT QUENCHING

[75] Inventor: Martin A. Murphy, Banstead, United Kingdom

[73] Assignee: Exxon Research and Engineering Company, Florham Park, N.J.

[21] Appl. No.: 841,272

[22] Filed: Mar. 19, 1986

[51] Int. Cl.[4] ..... C10G 11/00

[52] U.S. Cl. ..... 208/92; 208/358; 208/94; 208/106

[58] Field of Search ..... 208/92, 94, 348, 349, 208/354, 358, 357, 366, 368, 81–83, 102

[56] References Cited

U.S. PATENT DOCUMENTS

| | | | |
|---|---|---|---|
| 2,702,754 | 9/1956 | Offutt et al. | 208/94 |
| 2,904,510 | 9/1959 | Service, Jr. | 208/366 |
| 2,906,694 | 9/1959 | Dunlap et al. | 208/94 X |
| 3,133,014 | 5/1964 | Cross, Jr. | 208/348 |
| 3,136,706 | 6/1964 | Harper | 208/358 |
| 3,383,308 | 5/1968 | Wickham et al. | 208/350 |
| 3,413,211 | 11/1968 | Becraft et al. | 208/106 |
| 3,547,805 | 12/1970 | Mitchell | 208/348 |
| 3,549,519 | 12/1970 | Munro et al. | 208/106 X |
| 3,591,485 | 7/1971 | Mason, Jr. | 208/78 |

*Primary Examiner*—Andrew H. Metz

*Assistant Examiner*—Glenn A. Caldarola

*Attorney, Agent, or Firm*—Edward H. Mazer

[57] ABSTRACT

A hydrocarbon chargestock (11) is separated by distillation (12, 16), e.g. at least in part under reduced pressure, into a conversion feedstream (22, 24) and a vacuum residuum (17). The feedstream is converted at an elevated temperature in a conversion unit (25), e.g. a fluidized catalytic cracking system, to high temperature conversion products (26) which are passed into the bottom region of the lower portion (27) of a fractionation tower (28). The vacuum residuum (17) is passed (via 50) into the top of the lower portion (27) of the fractionation tower (28). Heat and mass transfer within the lower portion (27) of the tower desuperheat the conversion products and also strip from the vacuum residuum lower boiling materials thereby increasing the amount of useful hydrocarbon distillates recovered from the tower (28) and decreasing the amount of low value high boiling residue (30) discharged from the bottom of the tower and which is discarded for use as a fuel oil component and/or a feed for a subsequent conversion process (e.g. visbreaking, flexicoking, etc). The amount of cooling of high boiling materials (e.g. in heat exchangers 19, 33) is considerably reduced compared to known hydrocarbon conversion processes.

9 Claims, 2 Drawing Figures

HYDROCARBON CONVERSION PROCESS WITH PRODUCT QUENCHING

The present invention relates to a hydrocarbon conversion process.

In hydrocarbon conversion processes which are performed at elevated temperatures, many factors influence the efficiency of the process when regard is had to the amount of useful product obtained as a result of the conversion. Among these factors are the following: the amount of capital investment, the proportion of the hydrocarbon chargestock which is converted, the amount of low-value by-products of the conversion and the amount of energy involved in the conversion. Such factors and others must receive due consideration in high temperature conversion processes such as catalytic and thermal cracking (inter alia).

Heretofore, the hydrocarbon chargestock for such conversion processes has been separated by distillation into a fraction which is suitable for conversion and other fractions, among which are fractions of low utility, such as fuel oil. The converted fraction is substantially at the elevated conversion temperature and is passed to a fractionation tower in which separation into heavy and light conversion products occurs and is promoted. The heavier fractionated materials are withdrawn from the bottom of the fractionation tower, and a portion thereof is cooled and circulated back to the top of a lower zone of the fractionation tower where it serves to desuperheat and quench converted products entering the fractionation tower. It will be appreciated that the amount of heat which must be removed from the recirculated heavier fractionated materials to provide adequate desuperheating and quenching of the converted products is relatively great, and this is reflected in a correspondingly great investment in suitable cooling equipment.

U.K. patent specification No. 719003 describes examples of hydrocarbon conversion processes embodying the foregoing points and their attendant drawbacks. In the examples, the hydrocarbon chargestock is crude oil which is separated by distillation in an atmospheric pipestill into a plurality of fractions including a reduced crude boiling at 700° F.+ (371° C.). The reduced crude is passed to a conversion products fractionation tower which it enters at the top of the stripping section so as to quench and be stripped by hot effluent from a catalytic cracker so that a bottoms products is recovered from the bottom of the fractionation tower at a temperature of 820° to 830° F. (438° to 443° C.). The feed for the catalytic cracker is either wholly or mainly a gas oil fraction which is withdrawn from the fractionation tower at a location above the top of the stripping section. Some of the bottoms product is cooled to 700° F. (371° C.) and recirculated to the bottom of the tower to avoid cracking and the deposition of coke, and the remainder (amounting to 12 to 18% of the original feed) is discarded as a low value oil component.

Similar processes are described in UK patent specifications Nos. 762091 and 773524.

It is also known to subject the residuum from a crude oil atmospheric distillation tower to vacuum distillation in order to separate a plurality of streams, among which are a virgin gas oil stream (typically boiling in the range of from 300° to 600° C.) and a vacuum residuum, and to pass the virgin gas oil steam to a catalytic cracker, the vacuum residuum being discarded as a low value fuel oil component. In order to provide adequate quenching in the fractionator which receives cracker effluent, a relatively large amount of heat must be discharged from the bottoms product recovered from the bottom of the fractionator. Some of the bottoms product is also discarded as a fuel oil component of low value.

Heretofore, it has been considered that relatively large amounts of relatively low temperature high boiling materials, such as atmospheric residue or fractionator bottoms had to be circulated to the fractionator for desuperheating and quenching duties in order to avoid cracking and coke deposition occurring in the stripping section of the fractionator. It has now been discovered that relatively smaller quantities of cooled high boiling materials can be used for quenching and desuperheating in the fractionator without disadvantage, and indeed, with some advantage in terms of the reduced cooling duty and power required for circulation as reflected in heat exchanger investment and the cost of circulating pumps and the provision of cooling fluid, and in terms of the amount of hydrocarbon chargestock which is converted to increased amounts of useful products of relatively high value.

The present invention provides a hydrocarbon conversion process comprising the steps of:

(a) supplying a hydrocarbon chargestock to a distillation unit;

(b) separating the chargestock in the distillation unit into a plurality of streams including a conversion feed stream and a vacuum residue stream boiling within a higher temperature range than the conversion feed stream;

(c) passing the conversion feed stream to a hydrocarbon conversion unit wherein the conversion feed stream is converted to a converted hydrocarbon stream at a higher temperature than the conversion feed stream;

(d) passing the converted hydrocarbon stream into a lower region of a fractionation tower;

(e) passing at least some of the vacuum residue stream, at a temperature below that of the converted hydrocarbon stream, from the distillation unit into the fractionation tower at a level above the said lower region thereof to cause mass and heat transfer contact within the fractionation tower between the heavy feed stream and the converted hydrocarbon stream whereby volatile material is stripped from the vacuum residue stream; and (f) recovering from the fractionation tower a plurality of streams including a first fractionation stream containing volatile material stripped from the vacuum residue stream and a bottoms stream.

Preferably, the distillation unit comprises an atmospheric pressure distillation zone wherein an atmospheric residue is separated from the hydrocarbon chargestock under approximately atmospheric pressure, and a vacuum distillation zone operating under sub-atmospheric pressure which receives at least some atmospheric residue from the atmospheric pressure distillation zone and separates it into a plurality of discrete streams of which one is said vacuum residue stream and another is the said conversion feed stream.

Preferably, the temperature and/or pressure within the vacuum distillation zone and/or the fractionation tower is and/or are adjusted so that the vapour pressure of liquid leaving the lowest fractionation device of the vacuum distillation zone is higher than the vapour pressure of liquid leaving the lower fractionation device of the fractionation tower.

The hydrocarbon conversion unit may be a catalytic cracking unit (e.g. a fluid catalytic cracking unit, FCCU).

The invention also provides apparatus for performing the new process as described above.

BRIEF DESCRIPTION OF THE DRAWINGS

The invention is now further described by way of a non-limitative example thereof, and with reference to the accompanying drawings, in which.

Figure 1:
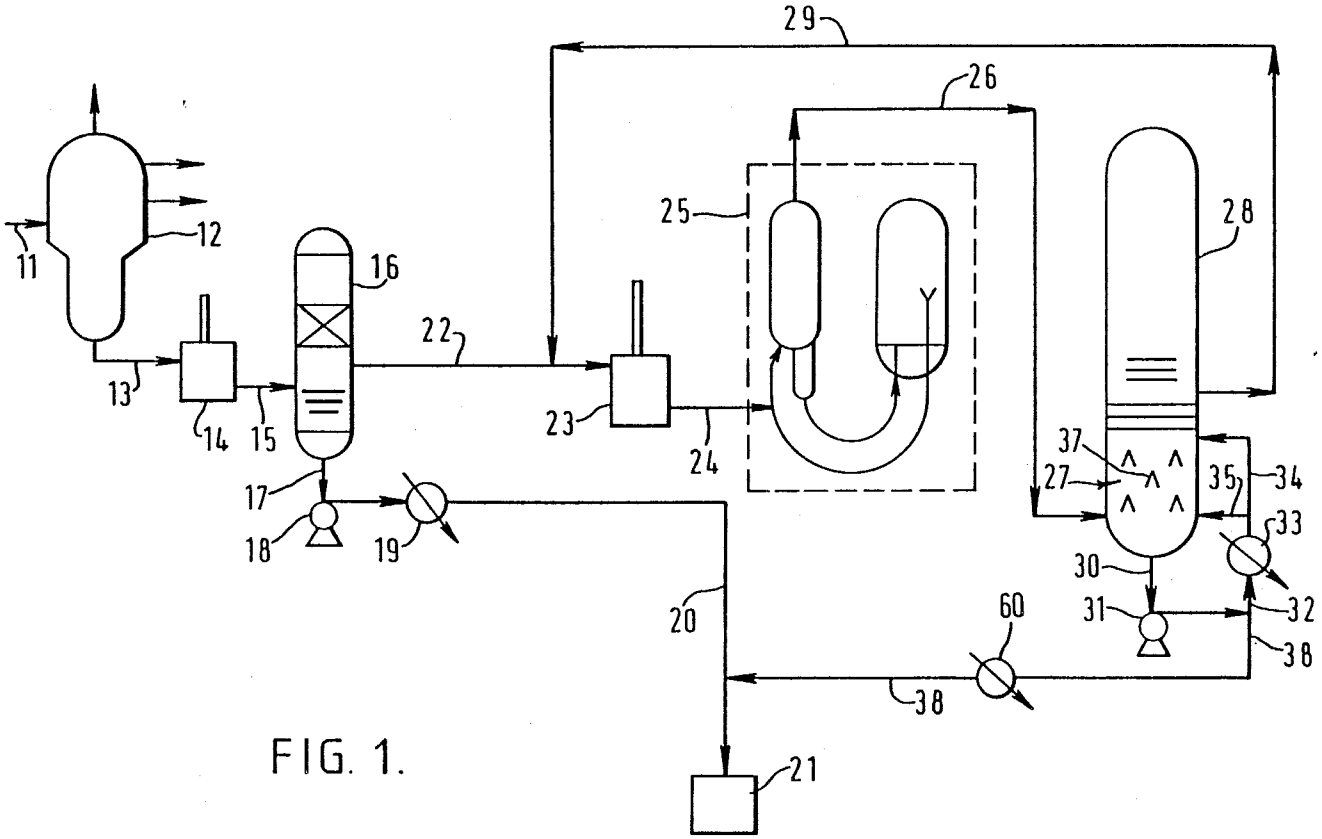
FIG. 1 is a simplified flow sheet showing the principal units of a known type of catalytic cracking plant.
Figure 2:
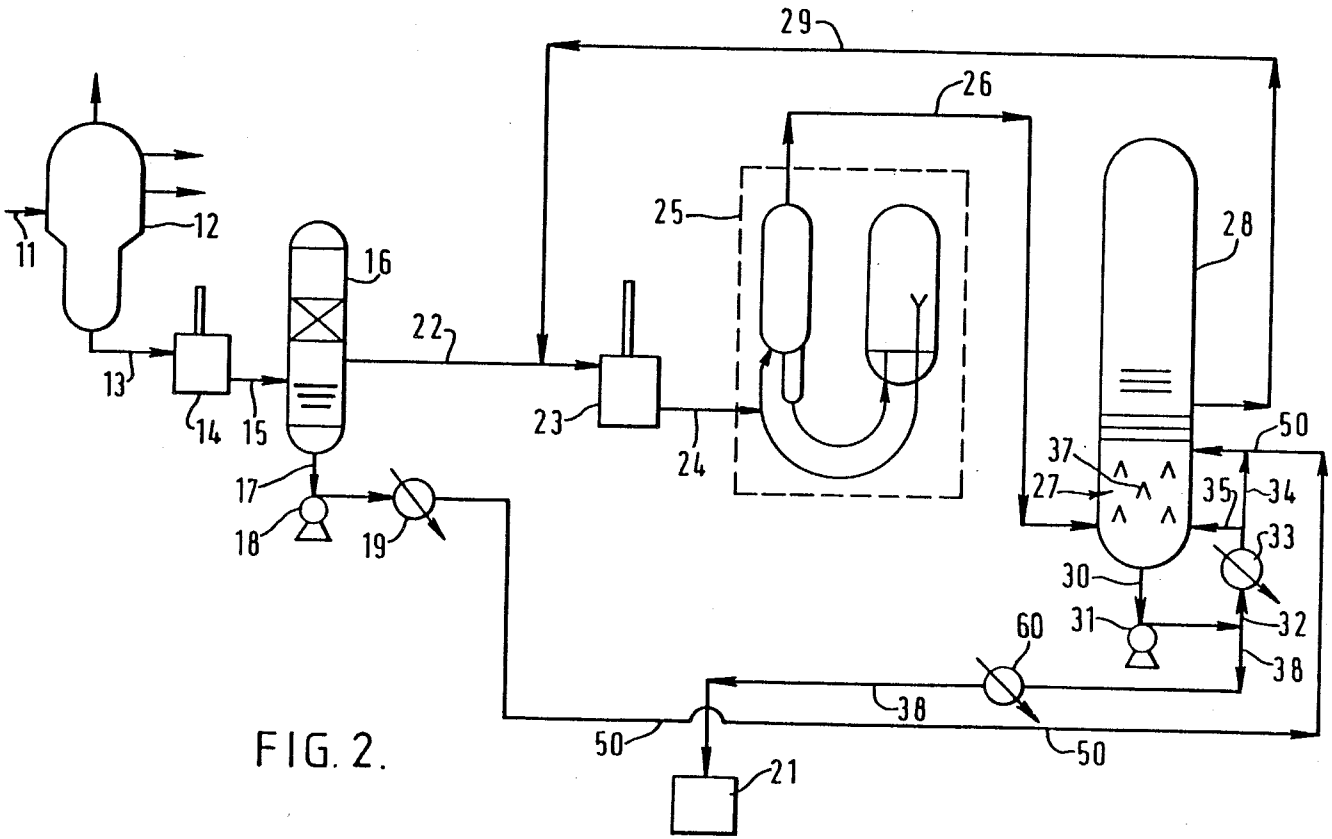
FIG. 2 is a simplified flow sheet showing the principal units of a catalytic cracking plant according to the present invention.

In both FIGS. 1 and 2, only those items necessary for an understanding of the known and new plant are shown.

Reference is first made to FIG. 1.

Crude oil is supplied via line 11 to an atmospheric pipestill ("APS") 12 wherein it is separated into a plurality of streams including an atmospheric residuum stream which is recovered from the bottom of APS 12 via line 13 and passed via a heating device, which in this instance, is a furnace 14, and line 15 to a vacuum pipestill ("VPS") 16 operated under subatmospheric pressure. The atmospheric residuum is separated into a plurality of streams including a gas oil stream, a vacuum residuum stream, and other streams. The vacuum residuum stream is removed from the bottom of the VPS 16 via line 17 and pump 18, and is thereafter cooled in heat exchanger 19 and then passed via line 20 to a receiving tank 21 wherein low utility, low value products are received for use as fuel oil blending components or as feed for other refining and/or conversion operations. The gas oil stream is passed from the VPS 16 via line 22 to a heating device, which in this instance, is a furnace 23, and thereafter via line 24 to a catalytic cracking unit 25 (enclosed within the broken lines) wherein the gas oil stream is converted in the reactor at an elevated temperature to catalytically cracked products. The latter are recovered via line 26 and passed at substantially the elevated temperature of the reactor into a lower part of the lower region 27 of a fractionating column 28. The lower region 27 operates as a desuperheating zone. Within the fractionating column, the cracked products are separated into a plurality of fractionation streams including normally gaseous streams (e.g. $H_2$, $CH_4$, $C_2H_6$, liquid petroleum gas fractions), normally liquid streams (e.g. light and heavy naphthas, kerosines), and higher boiling streams including a so-called cycle gas oil stream ("CGO stream") and a cracked residue. The normally gaseous and liquid streams are recovered from the fractionating column 28 via respective conduits (not shown) and reference will hereinafter be made only to the cycle gas oil and cracked residue streams. The CGO stream is recovered from the fractionating column 28 via line 29 and circulated to the cracking unit 25, in admixture with the gas oil stream in line 22, for further conversion in the cracking unit 25. The cracked residue is recovered from the bottom of the fractionating column 28 via line 30 under the action of pump 31.

In order to desuperheat and quench the hot cracked products entering the fractionating column 28, a major proportion of the cracked residue is passed via line 32 to heat exchanger 33 where it is cooled to a temperature approximating that at the top of the lower, desuperheating region 27. A major portion of the resulting cooled cracked residue is circulated via line 34 to the top of the desuperheating region 27 where it enters the fractionating column 28 and passes downwards in countercurrent to vapour phase cracked products rising up the desuperheating region 27 whereby some vapour phase cracked products are condensed and separation of the cracked products into different boiling fractions occurs. The remaining cooled cracked residue is passed via line 35 into the base region of the fractionating column 28 to provide additional local cooling and thereby prevent continued cracking and the formation and deposition of coke in the base region of the column 28. The temperature and rate of supply of cooled cracked residue to the desuperheating region 27 is at least sufficient to prevent cracking and concomitant coke deposition on the vapour-liquid contacting elements (for example, those known in the art as "sheds") 37 within the desuperheating region 27.

The portion of the cracked residue which is not passed via line 32 to the heat exchanger 33 is discarded via line 38 as a low value fuel oil component which is discharged into receiving tank 21 after it has been cooled to a suitable temperature (e.g. 250° F., 121° C.) for receipt and storage in the tank 21. The cooling is effected by a heat exchanger 60 in line 38.

Reference is now made to FIG. 2 in which most of the operating units and connecting lines are functionally identical or similar to those of FIG. 1 although, as will be appreciated by those skilled in petroleum refinery technology, they are not necessarily the same in capacity or structure. Accordingly, operating units and connecting lines in FIG. 2 which are functionally identical in FIG. 1 have been given the same reference numerals.

The principal distinction between the plants of FIGS. 1 and 2 is that whereas, in the FIG. 1 plant, the VPS residuum stream is cooled in heat exchanger 19 and then discarded via line 20 as, e.g. a fuel oil component, in the plant of FIG. 2, the VPS residuum, e.g. after cooling in the heat exchanger 19, is not discharged to the receiving tank 21 but is employed as at least part of the desuperheating and quenching medium in the fractionating column 28. To this end, the VPS residuum, after suitable cooling, is passed via line 50 into the top of the lower region 27 of the fractionating column 28. The cooling of the VPS residuum in FIG. 2 may be effected wholly in heat exchanger 19 or partly in heat exchanger 19 and partly in heat exchanger 33 or wholly in heat exchanger 33 (in which case, heat exchanger 19 may be eliminated from the FIG. 2 embodiment).

The contact between the rising hot cracked products entering column 28 and the descending cooled VPS residuum not only causes desuperheating and quenching of the former but additionally heating of the VPS residuum with attendant separation of the latter into vapourised fractions which rise up the interior of the column 28 and at least partly contribute to the gas oil recycle stream in line 29, and non-vapourized fractions thereof which descend to the base of the column where they are recovered via line 30 in admixture with cracked residue. The resulting mixture of fractionated VPS residuum and cracked residue, hereinafter termed "mixed residue", is circulated by pump 31 in part to heat exchanger 33 wherein it is cooled before being passed via lines 34 and 35 to the bottom region of the lower zone 27 in order to reduce temperatures therein and thereby reduce cracking and coke deposition. The remaining part of the mixed residue is is conveyed by line 38 to receiving tank 21 for use as a fuel oil component and/or as a feed for use in a further conversion operation such as visbreaking, coking and/or flexicoking.

The benefits and advantages of the process and plant of the present invention (e.g. as exemplified by FIG. 2) compared to a conventional process and plant (e.g. as exemplified by FIG. 1) include the following:

1. An increased proportion of the crude oil chargestock is converted to cracked products of relatively high utility (e.g. naphthas). This is a result of the additional gas oil in the recycle stream in line 29 which has been separated from the VPS residuum which is passed into the fractionating column 28 (rather than discarded as a fuel oil component, as exemplified by FIG. 1).

2. A reduced proportion of the crude oil charge is discharged as a low quality fuel oil component.

3. The cooling duty of the heat exchanger 33 is considerably smaller. It is therefore possible to reduce the capital investment in, and operating costs of, the heat exchanger 33 for the practice of the invention.

4. The mean residence time and amount of liquid holdup in the stripping/desuperheating lower region 27 are both greatly reduced thereby reducing the tendency for cracking and coke deposition to occur in region 27. The mean residence time and amount of liquid holdup in the region 27 are both reduced by a factor in the range of from 3:1 to 6:1, e.g about 4:1, compared to the residence time and liquid holdup volume in accordance with prior practice as exemplified by FIG. 1. The reduced tendency for cracking and coke deposition to occur in the stripping region 27 is regarded as somewhat surprising, particularly when the invention is practised with temperatures in the stripping/desuperheating lower region 27 increased compared to the temperatures normally employed in the corresponding region of the fractionator of known types of plant (e.g., as exemplified by FIG. 1).

Although the plant of FIG. 2 does not differ greatly from FIG. 1, the benefits arising from the difference are considerable, particularly when considered in the context of the continued vigorous striving to increase the proportion of crude oil converted to high utility products such as naphtha, and having regard to the enormous amounts of crude oil which are converted in typical refineries such that the smallest percentage increase in the proportionate output of high utility products is worth large sums of money.

A further surprising feature of the practice of the invention is that heretofore, it has been considered that VPS residuum would be highly undesirable within the desuperheating lower region 27 of the fractionating tower because it would crack and cause coke deposition and, moreover, act to reduce the amount of higher utility materials available in the streams recovered from the rectifying zone (above the level of the lower region 27) of the fractionating column 28 by absorbing some of said higher utility materials. It has been discovered that, contrary to this long-held expectation, no such drawback occurs.

A highly preferred feature in the practice of the invention is that the vapour pressure of fluid leaving the lowest fractionating device (e.g. tray, packing element) of the VPS 16 should be higher than the vapour pressure of fluid leaving the lowest fractionating device of the fractionating column 28. The manner in which this preferred feature can be realized will be well-known in those skilled in petroleum refining technology. In principle, it may be realized by arranging that (a) the pressure at the bottom of the VPS 16 is greater than that at the bottom of the fractionating column 28 or (b) the temperature at the bottom of the fractionating column 28 is greater than that at the bottom of the VPS 16, or (c) a suitable combination of (a) and (b). Those skilled in the art will know how to achieve effects (a) and/or (b).

In order to illustrate further the invention, the following data are presented comparing typical conditions in plant according to FIG. 1 and plant according to FIG. 2. The numbered items in the left-hand column of the following table represent the referenced equipment in the flow sheets of the drawings.

TABLE

| Item No. | Reference | FIG. 1 | FIG. 2 |
|---|---|---|---|
| 1 | 13 Temperature | 650° F. (343° C.) | 650° F. (343° C.) |
| 2 | 15 Temperature | 750° F. (399° C.) | 750° F. (399° C.) |
| 3 | 17 Flow-rate | 9082 B/D ($1.444 \times 10^6$ liters/day) | 9082 B/D ($1.444 \times 10^6$ liters/day) |
| 4 | 20 Temperature | 250° F. (121° C.) | — |
| 5 | 50 Temperature | — | 250° F. (121° C.) |
| 6 | 27 Residence time, minutes | 60 | 14 |
| 7 | 30 Temperature | 612° F. (322° C.) | 750° F. (399° C.) |
| 8 | 38 Temperature | 250° F. (121° C.) | 250° F. (121° C.) |
| 9 | 38 Flow-rate | 2000 B/D ($3.18 \times 10^5$ liters/day) | 8737 B/D ($1.389 \times 10^6$ liters/day) |
| 10 | 21 Flow-rate | 11082 B/D ($1.762 \times 10^6$ liters/day) | 8737 B/D ($1.389 \times 10^6$ liters/day) |
| 11 | 21 Temperature | 250° F. (121° C.) | 250° F. (121° C.) |
| 12 | 32 Flow-rate | 36743 B/D ($5.842 \times 10^6$ liters/day) | 1145 B/D ($0.182 \times 10^6$ liters/day) |
| 13 | 33 Cooling Duty | $77 \times 10^6$ Btu/hour ($81.24 \times 10^6$ kJ/hour) | $2.4 \times 10^6$ Btu/hour ($2.53 \times 10^6$ kJ/hour) |
| 14 | 29 Flow-rate | 2500 B/D (397,500 liters/day) | 4847 B/D (770,673 liters/day) |
| 15 | 26 Temperature | 950° F. (510° C.) | 950° F. (510° C.) |
| 16 | 60 Cooling Duty | $6 \times 10^6$ Btu/hour ($6.33 \times 10^6$ kJ/hour) | $40.2 \times 10^6$ Btu/hour ($42.1 \times 10^6$ kJ/hour) |

Notes:
B/D = Barrels/day: 1 barrel = 159 liters.
Btu = British thermal unit. 1 Btu = 1.055 kJ When the data for FIGS. 1 and 2 are compared, the following points are highly significant:

(a) the amount of material rejected for fuel oil blending in vessel 21 is $1.762 \times 10^6$ l/day in FIG. 1 compared with $1.389 \times 10^6$ l/day in FIG. 2.

(b) the cooling duty of heat exchanger 33 is greatly reduced in FIG. 2 compared with FIG. 1.

(c) the residence time in the lower region 27 of fractionating column 28 in FIG. 2 is much lower than it is for FIG. 1.

(d) the recycled gas oil in line 29 available for conversion in the reactor 25 is considerably greater in the FIG. 2 embodiment than it is for the FIG. 1 embodiment. Accordingly, the amounts of naphtha and other high value products are significantly increased by the practice of the invention.

Despite the foregoing, the amount of cracking and coke deposition in the bottom of the fractionating column 28 is about the same or less in the FIG. 2 plant compared with the FIG. 1 plant.

I claim:

1. A hydrocarbon conversion process comprising the steps of:

(a) supplying a hydrocarbon chargestock to a distillation zone;

(b) separating said chargestock in said distillation zone into a plurality of fractions including a vacuum residue fraction and a cracking feed fraction boiling within a temperature range lower than that of the vacuum residue;

(c) passing at least a portion of said cracking feed fraction to a cracking zone wherein said fraction is cracked to lower boiling product to produce cracked product at a temperature higher than the temperature of said cracking feed fraction fed to said distillation zone;

(d) passing at least a portion of said cracked product into a lower region of a fractionation zone;

(e) passing at least some of the vacuum residue stream, at a temperature below that of the cracked product, from said distillation zone into said fractionation zone of (d) above at a level above the said lower region thereof to cause mass and heat transfer contact within the fractionation zone between the heavy feed stream and the cracked product whereby volatile material is stripped from the vacuum residue stream; and (f) recovering from said fractionation zone a plurality of streams including a first fractionation stream containing volatile material stripped from the vacuum residue stream and a bottoms stream.

2. A process as in claim 1 in which the distillation zone comprises an atmospheric pressure distillation zone wherein an atmospheric residue is separated from the hydrocarbon chargestock under approximately atmospheric pressure, and a vacuum distillation zone operating under subatmospheric pressure and which receives at least some atmospheric residue from the atmospheric pressure distillation zone and separates it into a plurality of discrete streams of which one is said vacuum residue stream and another is the said cat cracker feed stream.

3. A process as in claim 2 in which the temperature and/or pressure within the vacuum distillation zone and/or the fractionation zone is and/or are so adjusted that the vapour pressure of liquid leaving the lowest fractionation device of the vacuum distillation zone is higher than the vapour pressure of liquid leaving the lowest fractionation device of the fractionation zone.

4. A process as in claim 2 in which the vacuum residue which is added to the fractionation zone is cooled before entering the fractional tower.

5. A process as in claim 1 in which at least part of the said fractionation stream recovered from the said fractionation zone is recirculated to the cracking zone.

6. A process as in claim 1 in which a portion of said bottoms stream is circulated to a stripping/desuperheating zone of said fractionation zone.

7. A process as in claim 6 in which the amount of bottoms stream remaining after circulation of the said portion of the bottoms stream to the fractionation zone is less than the amount of the vacuum residue stream.

8. A process as in claim 6 in which said portion of the bottoms stream which is circulated to said fractionation zone is cooled before entering the said stripping-/desuperheating zone of said fractionation zone.

9. A process as in claim 1 in which the residence time or hold-up time of liquid in the stripping section of said fractionation zone is not more than 30 minutes.

* * * * *